US005112236A

United States Patent [19]

Martin et al.

[11] Patent Number: 5,112,236

[45] Date of Patent: May 12, 1992

[54] ELECTRICAL CONTACT

[75] Inventors: Jean-Paul Martin, St. Pierre du Perray; Jean-Claude Moisand, Bois D'Arcy, both of France

[73] Assignee: Societe Cetra S.a.r.l., La Croix Blanche Ouest, France

[21] Appl. No.: 701,289

[22] Filed: May 16, 1991

[30] Foreign Application Priority Data

May 17, 1990 [FR] France ..... 90 06600

[51] Int. Cl.[5] ..... H01R 4/58; H01R 3/08; H01R 13/53

[52] U.S. Cl. ..... 439/86; 200/26 A; 439/179; 439/186

[58] Field of Search ..... 439/86, 88, 178, 179, 439/186, 187; 200/264

[56] References Cited

U.S. PATENT DOCUMENTS 2,200,125 5/1940 Slepian ..... 200/264
5,006,286 4/1991 Dery et al. ..... 439/86

FOREIGN PATENT DOCUMENTS 1104609 7/1984 U.S.S.R. ..... 439/179

*Primary Examiner*—Paula A. Bradley
*Attorney, Agent, or Firm*—Herbert Dubno

[57] ABSTRACT

An electrical contact comprising a male element and a female element in which the male element is mounted for sliding with a tight fit, an air chamber being formed between an end of the male element and a bottom of the female element, the male and female elements being at least partially made from a porous material impregnated with an aqueous solution charged with submicron metal particles.

3 Claims, 1 Drawing Sheet

ELECTRICAL CONTACT

FIELD OF THE INVENTION

The present invention relates to an electrical contact which can be used separately or as an element of a switch, contact-maker, relay or connector.

SUMMARY OF THE INVENTION

The contact of the invention is characterized in that it comprises a male element and a female element in which the male element is mounted for sliding with a tight fit, an air chamber being provided between the end of the male element and the bottom of the female element. These two male and female elements are at least partially made from a porous material impregnated with an aqueous solution charged with submicron metal particles.

In a first embodiment, the male and female elements are in the form of envelopes containing the aqueous solution.

In another embodiment, the male and female elements are monolithic and impregnated with the aqueous solution.

SPECIFIC DESCRIPTION

Figure 1:
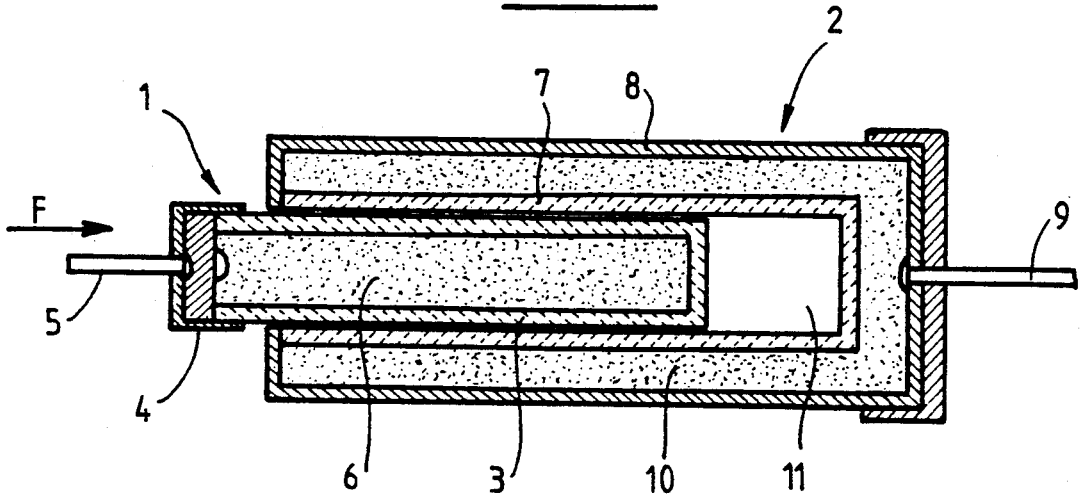
FIGS. 1 and 2 are axial sectional views of two embodiments of the invention.

As can be seen from FIG. 1, the contact of the invention comprises a male element 1 and a female element 2 in which male element 1 is mounted for sliding with a tight fit.

The male element 1 is formed by a cylindrical envelope 3 made from a porous material, for example from ceramic or alumina, which is closed by a cap 4 carrying a connecting wire 5 and contains an aqueous solution 6 containing submicron metal particles, with very high conductivity and very low resistance, the particles having a diameter of 10 to 1000 times smaller than the diameter of the pores of the envelope 3; the female element 2 is formed by an envelope which comprises a porous material wall 7 and a metal wall 8 carrying a connecting wire 9 and contains a solution 10 similar to solution 6. The two elements 1 and 2 define an air-filled chamber 11.

When the male element 1 is fitted in the female element 2, as shown by arrow F, by moving element 1 or element 2, the air in chamber 11 is compressed and passes through the pores of the walls of this chamber while exerting an overpressure on solutions 6 and 10.

These solutions pass by capillarity through the facing walls 3 and 7 which are moreover compressed and exude, like sponges, the liquid which impregnates them; the solutions thus form between the walls a conducting film which lets the current pass.

Conversely, when the male element 1 is removed from the female element 2, the film of aqueous solution is resorbed by the pores inside the envelopes which cease to be compressed and the passage of the current is interrupted.

Figure 2:
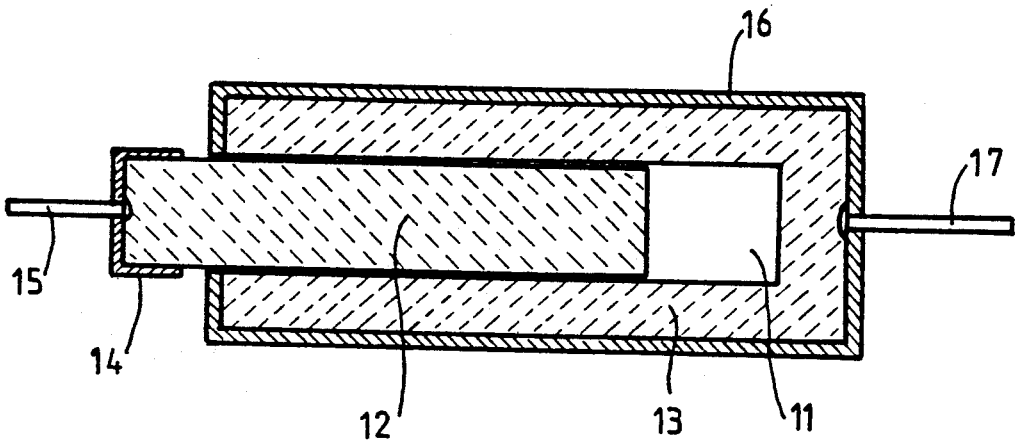

In the embodiment shown in FIG. 2, the contact is formed by the male element 12 and female element 13 which are made from a microporous material having a high coefficient of elasticity and are impregnated with a viscous compound charged with submicron metal particles. The male element 12 is closed externally by a cap 14 carrying a connecting wire 15 whereas the female element 13 is housed in an envelope 16 carrying a connecting wire 17. This contact operates like the one described above. When the male element 12 is driven into the female element the air in chamber 11 is compressed and a conducting film is formed between elements 12 and 13.

The contact of the invention exhibits no bouncing on closure and no electric arc is formed. It operates perfectly well with VHF because of the skin effect, it has a low contact resistance and responds excellently to the microcurrents.

It goes without saying that the present invention should not be considered as limited to the embodiments described and shown but covers, on the contrary, all variants thereof. Thus, for example, a change-over switch could be formed by providing two contacts and connecting their male elements to the same control lever so that, when one of the male elements is driven into its female element, the other comes out and conversely.

We claim:

1. An electrical contact comprising a male element and a female element in which said male element is mounted for sliding with a tight fit, an air chamber being formed between an end of said male element and a bottom of said female element, said male and female elements being at least partially made from a porous material impregnated with an aqueous solution charged with submicron metal particles.

2. A contact according to claim 1 wherein said male and female elements are in the form of envelopes containing said aqueous solution.

3. A contact according to claim 1 wherein said male and female elements are monolithic and impregnated with the aqueous solution.

* * * * *